US006875087B2

(12) United States Patent
Mitchel et al.

(10) Patent No.: US 6,875,087 B2
(45) Date of Patent: Apr. 5, 2005

(54) METHOD FOR CHEMICAL MECHANICAL PLANARIZATION (CMP) AND CHEMICAL MECHANICAL CLEANING (CMC) OF A WORK PIECE

(75) Inventors: Marie Mitchel, Phoenix, AZ (US); John L. Shartel, II, Chandler, AZ (US); Yakov Epshteyn, Phoenix, AZ (US)

(73) Assignee: Novellus Systems, Inc., Chandler, AZ (US)

( * ) Notice: Subject to any disclaimer, the term of this patent is extended or adjusted under 35 U.S.C. 154(b) by 0 days.

(21) Appl. No.: 10/438,030

(22) Filed: May 13, 2003

(65) Prior Publication Data

US 2004/0229550 A1 Nov. 18, 2004

(51) Int. Cl.[7] ..... B24B 1/00
(52) U.S. Cl. ..... 451/41; 451/36
(58) Field of Search ..... 451/41, 36, 60; 438/691, 692, 693

(56) References Cited

U.S. PATENT DOCUMENTS 5,320,706 A * 6/1994 Blackwell ..... 438/693
5,478,436 A * 12/1995 Winebarger et al. ..... 438/693
5,704,987 A * 1/1998 Huynh et al. ..... 134/6
5,972,124 A * 10/1999 Sethuraman et al. ..... 134/7
6,152,148 A * 11/2000 George et al. ..... 134/2
6,391,779 B1 * 5/2002 Skrovan ..... 438/691
6,394,883 B1 * 5/2002 Carlson et al. ..... 451/66

* cited by examiner

*Primary Examiner*—Dung Van Nguyen
(74) *Attorney, Agent, or Firm*—Ingrassia Fisher & Lorenz PC

(57) ABSTRACT

A method is provided for planarizing/polishing and subsequently in situ cleaning a surface of a work piece such as a semiconductor wafer. The method includes the steps of planarizing/polishing the surface of a work piece by subjecting a work piece surface to a chemical mechanical planarization/polishing (CMP) process on a chemical mechanical planarization/polishing platen such that the planarization/polishing process leaves the surface of the work piece hydrophobic. The planarization/polishing process is followed by a chemical mechanical cleaning (CMC) process in which the planarized/polished surface of the work piece is subjected to the cleaning process on the same chemical mechanical planarization/polishing platen such that the cleaning process leaves the surface of the work piece hydrophilic.

19 Claims, 2 Drawing Sheets

METHOD FOR CHEMICAL MECHANICAL PLANARIZATION (CMP) AND CHEMICAL MECHANICAL CLEANING (CMC) OF A WORK PIECE

TECHNICAL FIELD OF THE INVENTION

The present invention generally relates to a method for planarizing a work piece, and more particularly relates to a method for chemical mechanical planarization and subsequent chemical mechanical cleaning of a work piece such as a semiconductor wafer.

BACKGROUND OF THE INVENTION

The manufacture of many types of work pieces requires the substantial planarization or polishing of at least one surface of the work piece. Examples of such work pieces that require a planar surface include semiconductor wafers, optical blanks, memory disks, and the like. Without loss of generality, but for ease of description and understanding, the following description of the invention will focus on applications to only one specific type of work piece, namely a semiconductor wafer. The invention, however, is not to be interpreted as being applicable only to semiconductor wafers. Those of skill in the art instead will recognize that the invention can be applied to any generally disk shaped work pieces.

One commonly used technique for planarizing the surface of a work piece is the chemical mechanical planarization (CMP) process. The terms "planarization" and "polishing," or other forms of these words, although having different connotations, are often used interchangeably by those of skill in the art with the intended meaning conveyed by the context in which the term is used. For ease of description such common usage will be followed and the term "chemical mechanical planarization" will generally be used herein with that term and "CMP" conveying either "chemical mechanical planarization" or "chemical mechanical polishing." In the CMP process a work piece, held by a work piece carrier head, is pressed against a polishing pad in the presence of a polishing slurry. The polishing pad is mounted on a platen and the work piece is moved relative to the polishing pad by placing the work piece and/or the platen in motion. The mechanical abrasion of the surface caused by the relative motion of the work piece with respect to the polishing pad combined with the chemical interaction of the slurry with the material on the work piece surface ideally produces a planar surface.

The conventional CMP process, for example as applied to a bulk silicon wafer, uses a two step, two platen process. The first platen is used for the primary polishing of the surface of the silicon wafer and the second platen is used to improve surface roughness, reduce haze, and to reduce the number of particulates remaining after the primary polish. The primary polishing is accomplished with a basic aqueous colloidal or fumed silica slurry and a porous polishing pad. The second process step on the second platen is intended to remove the majority of the residual slurry particles and surface damage remaining on the surface from the primary polish step. Typically different CMP parameters are used on the second platen including an alternative speed of relative motion between the wafer and the polishing pad, an alternative wafer pressure, extended rinse times, and the addition of surfactants to improve wettability of the wafer surface and to suppress the redeposition of particles on the wafer surface. The second process step is usually followed by a third step in which the wafer is transferred to a contact poly vinyl acetate (PVA) brush cleaning station at which the wafer is mechanically scrubbed and rinsed.

There are a number of inherent limitations in the present CMP process, especially as critical dimensions (CDs) of semiconductor devices manufactured on the silicon wafer decrease. As the CD decrease, so also does the size of "killer defects" defined as 50% of CD. Killer defects are those defects which have a high probability of causing malfunctioning of the semiconductor device. The first polishing step on the first platen leaves the surface of the silicon wafer hydrophobic. The hydrophobic surface allows particles to dry on the wafer surface during the wafer transfer from the first platen to the second platen. The particles that dry on the wafer surface chemically bond to that surface One of the accepted "rules" for post CMP cleaning (see, for example, Shin et al., *Chemical Mechanical Polishing in Silicon Processing*; Academic Press: New York, 2000; Vol. 63. 228–240ff, 183–213ff, 31–34ff.) is to never allow the polishing slurry to dry on the wafer surface. Allowing the wafer surface to dry greatly reduces the efficiency of cleaning the silicon to the extent that only re-polishing may be effective in removing the chemically bonded particles. Additionally, PVA brushes become less effective in removing particles as the particle size decreases because the area and mass of the particles decreases more rapidly than the adhesive forces keeping the particles on the silicon surface. Consequently the PVA brushes exert insufficient drag and lift on small particles, making the PVA brush cleaning technology ineffective. Further, in addition to being ineffective in removing small particles, the PVA brushes are consumables; the PVA material wears during the cleaning process and the material can be transferred to the silicon surface adding an additional contaminate to the surface. PVA brushes can also become loaded with both silicon particles and slurry particles as well as other CMP byproducts. These particles and byproducts can be transferred to subsequent otherwise clean wafers and can cause both contamination and micro scratches. To reduce the loading, the PVA brushes must be periodically flushed with, for example, with a diluted ammonium hydroxide solution. The process of flushing the brushes is time consuming. Supplying the flushing solution and replacing the consumable PVA brushes add to the cost of the overall CMP process.

Accordingly, it is desirable to provide a CMP process that yields a surface of the desired planarity without leaving contaminates on the work piece surface. In addition, it is desirable to provide a CMP process that yields the desired surface planarity at a lower cost and at a higher throughput and efficiency. Still further, it is desirable to provide a chemical mechanical cleaning (CMC) process, for the efficient cleaning of a work piece following chemical mechanical planarization of that work piece. Furthermore, other desirable features and characteristics of the present invention will become apparent from the subsequent detailed description and the appended claims, taken in conjunction with the accompanying drawings and the foregoing technical field and background.

BRIEF SUMMARY OF THE INVENTION

A method is provided for planarizing and subsequently in situ cleaning a surface of a work piece such as a semiconductor wafer. The method includes the steps of planarizing the surface of a work piece by subjecting a work piece surface to a chemical mechanical planarization (CMP) process on a chemical mechanical planarization platen such that the planarization process leaves the surface of the work piece hydrophobic. The planarization process is followed by a chemical mechanical cleaning (CMC) process in which the planarized surface of the work piece is subjected to the cleaning process on the same chemical mechanical planarization platen such that the cleaning process leaves the surface of the work piece hydrophilic.

BRIEF DESCRIPTION OF THE DRAWINGS

The present invention will hereinafter be described in conjunction with the following drawing figures, wherein like numerals denote like elements, and wherein FIG. 1. illustrates schematically in cross section a chemical mechanical planarization apparatus in which the invention can be practiced.

DETAILED DESCRIPTION OF THE INVENTION

The following detailed description is merely exemplary in nature and is not intended to limit the invention or the application and uses of the invention. Furthermore, there is no intention to be bound by any expressed or implied theory presented in the preceding technical field, background, brief summary or the following detailed description.

Figure 1:
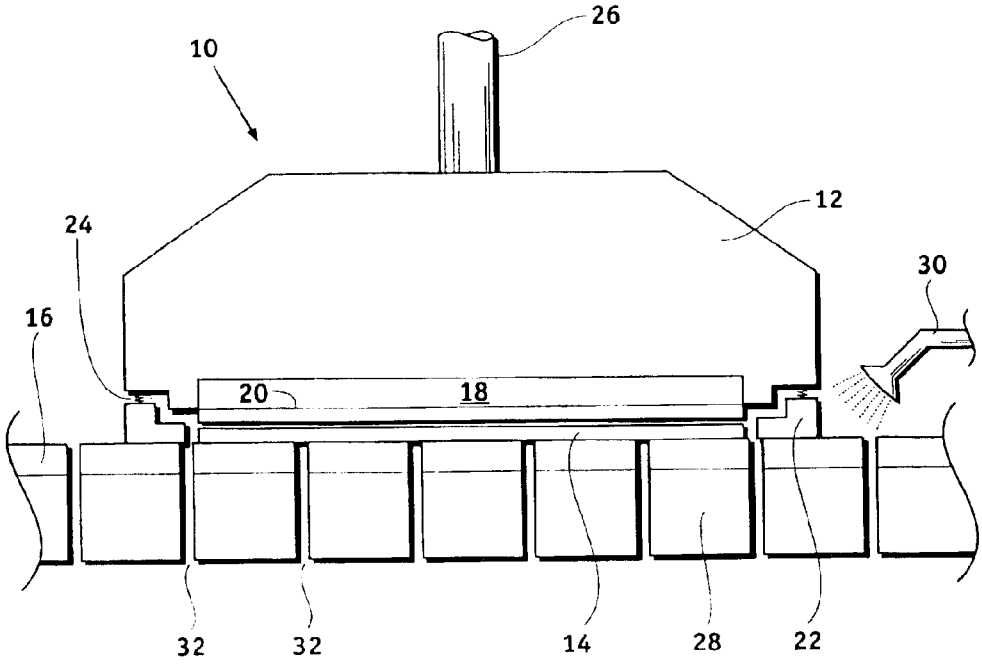
FIG. 1 (PRIOR ART)

FIG. 1 illustrates schematically, in cross section, one form of chemical mechanical planarization (CMP) apparatus 10 in which the invention can be practiced. This apparatus is merely exemplary of one type of CMP apparatus that can be employed in carrying out a CMP process and a chemical mechanical cleaning (CMC) process, each in accordance with various embodiments of the invention. CMP apparatus 10 includes a carrier head 12 for controllably pressing a work piece 14 such as a semiconductor wafer against a polishing pad 16. Carrier head 12 includes a rigid casing having a cavity 18 on a lower surface. A flexible membrane or contoured carrier film 20 is stretched across the cavity and presses against the upper surface of work piece 14. A wear ring 22 is attached to the rigid carrier head with a resilient attachment here illustrated by springs 24. The wear ring surrounds cavity 18 and serves to precondition the polishing pad and to contain the lateral movement of work piece 14, thus maintaining the work piece in position on the underside of carrier head 12. Carrier head 12 is attached to a shaft 26 by means of which the correct downward pressure can be applied to the carrier head and hence to work piece 14. Shaft 26 may also be used to impart a rotational motion to carrier head 12 to improve the uniformity of the polishing action. The polishing pad is mounted on a platen 28. Although exemplary CMP apparatus 10 is of the type generally referred to as a "front referenced carrier," the invention is equally applicable to front or back referenced carriers.

Figure 2:
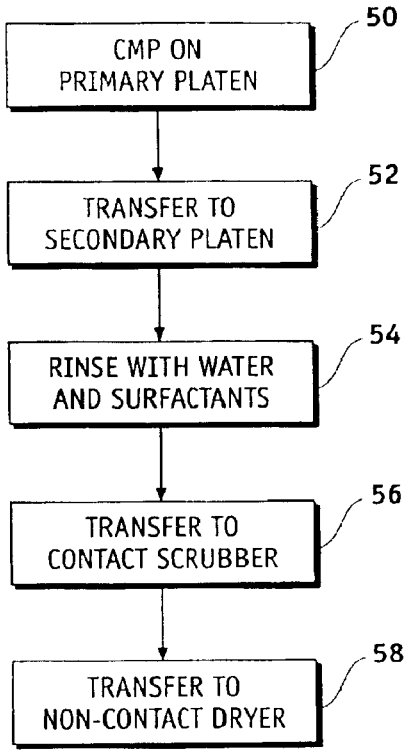
FIG. 2 (PRIOR ART)
FIG. 2 illustrates, in flow chart format, a method for planarizing a work piece in accordance with a conventional method.

FIG. 2 illustrates, in flow chart format, a conventional CMP process using a CMP apparatus such as apparatus 10. In accordance with the conventional process, and with continued reference to FIG. 1, work piece 14 is pressed into contact with polishing pad 16 in the presence of a polishing slurry (step 50). The slurry can be applied to the polishing pad, for example, by an applicator schematically illustrated at 30 or can be injected through holes 32 in the platen and polishing pad. A suitable manifold and delivery system (not illustrated) would distribute the slurry to the holes. The polishing pad can be a commercially available polishing pad such as model UR 100 available from Rodel of Phoenix, Ariz. and the slurry can be a commercially available silica slurry such as Advansil 2000 also available from Rodel. The pressure on the work piece is exerted by the carrier head through the pressure from shaft 26. To obtain an appropriate pressure distribution across the back (or upper) surface of the work piece and thus an appropriate material removal rate uniformity across the front (or lower) surface of the work piece pressure is exerted against flexible membrane 20 by pressurized gasses or fluids that are conveyed to cavity 18. The flexible membrane conforms to the shape of the back surface of work piece 14 and presses the work piece against the polishing pad. Although only a single cavity 18 is illustrated, in some applications multiple cavities and multiple pressures are used to press the work piece against the polishing pad in an attempt to achieve the desired removal rate. To maintain even removal rate across the front surface of the work piece on non-membrane work piece carriers, contoured films are pressed against the back surface of the work piece, and removal rate uniformity is controlled by film contour, carrier oscillation diameter, platen rotational speed, and applied work piece pressure. Platen 28 and polishing pad 16 mounted thereon may be in rotational, orbital, linear, or other motion relative to work piece 14. Carrier head 12 may also be rotating on shaft 26. Following the planarization of a work piece in apparatus 10, in the conventional process the work piece is removed from the carrier head and is transferred to a similar carrier head and the process is continued on a second polishing pad attached to a second platen (Step 52). Instead of transferring the work piece to a second carrier head, the carrier head with the work piece attached may be moved to position the work piece over a second polishing pad and second platen. At the second platen the work piece is again brought into pressure contact with the polishing pad (although the processing conditions such as pressure and speed of relative motion may be different) and the work piece is rinsed in a cleaning fluid to which surfactants have been added to attempt the removal of the majority of the residual slurry particles (Step 54). Following the processing at the secondary platen, the work piece is transferred to a PVA mechanical brush station for final cleaning (Step 56). At the brush station the work piece is scrubbed with the PVA brushes in deionized water and ammonium hydroxide. The conventional process is completed by transferring the work piece to a non-contact dryer such as a spin rinse dryer (Step 58).

Figure 3:
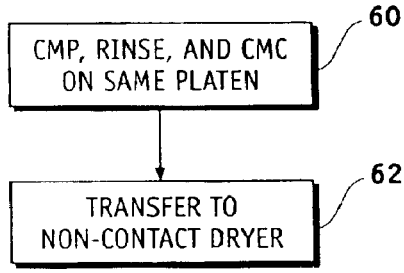
FIG. 3 illustrates, in flow chart format, a method for planarizing a work piece in accordance with an embodiment of the invention.

FIG. 3 illustrates, in flow chart format, a process for chemical mechanical planarization of a work piece in accordance with an embodiment of the invention. In accordance with this embodiment of the invention, a work piece such as a silicon wafer is loaded into a CMP apparatus such as CMP apparatus 10 illustrated in FIG. 1 (Step 60). For purposes of illustration only, the work piece will be considered to be a silicon wafer having, after CMP processing, bare silicon exposed on at least of portion of the planarized surface. The silicon wafer can be, for example, a bulk monocrystalline silicon wafer, a silicon wafer having semiconductor devices at least partially completed at the wafer surface, a substrate having a layer of polycrystalline silicon on the surface, or a silicon on insulator wafer (SOI) having a layer of exposed monocrystalline silicon at the surface. In accordance with one embodiment of the invention, the silicon wafer is loaded into the CMP apparatus, pressed against a polishing pad attached to a polishing platen, and is planarized using a silica slurry. Because of the chemical action of the slurry on the wafer, following the planarization, the exposed silicon on the surface of the wafer is hydrophobic. On the same apparatus, the planarized wafer is then pressed against the same polishing pad on the same platen and is rinsed in deionized water and then cleaned in a basic cleaning solution that oxidizes the surface of the wafer making it hydrophilic. That is, the wafer is chemical mechanically planarized, rinsed and chemical mechanically cleaned (CMC) on the same polishing pad and platen (Step 60). During all of the foregoing processing, the wafer surface remains continuously in contact with the polishing pad. Following the CMC the wafer surface is hydrophilic, so the surface does not immediately dry and residual slurry particles do not adhere to the surface. The wafer can then be dried, for example, in a conventional non-contact dryer such as a spin rinse dry station (Step 62).

Figure 4:
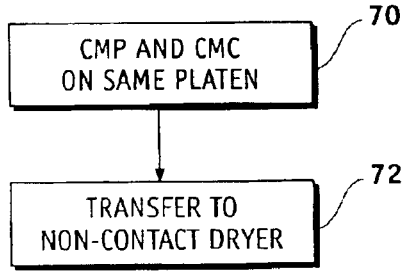
FIG. 4. illustrates, in flow chart format, a method for planarizing a work piece in accordance with a further embodiment of the invention.

In accordance with a further embodiment of the invention, as illustrated in FIG. 4, the separate rinse step may be eliminated. Thus in Step 70, the wafer is pressed against a polishing pad in the presence of a slurry to polish the silicon surface. The process conditions are then changed and the wafer surface, still in contact with the polishing pad, is rinsed and oxidized in a silicon oxidizing solution. The method in accordance with this embodiment thus comprises a CMP step followed by a CMC step, both performed on the same polishing pad and platen. Following the CMC step, the wafer surface is hydrophilic so the surface does not immediately dry and residual slurry particles do not adhere to the surface. The wafer can then be dried, for example, in a conventional non-contact dryer such as a spin rinse dry station (Step 72).

The following non-limiting example serves to illustrate practice of the invention. Two groups of bare 200 mm diameter silicon wafers were planarized, one group in accordance with a prior art process and one group in accordance with an embodiment of the invention. Both groups of wafers were processed on a Momentum orbital CMP apparatus available from Novellus, Inc. of San Jose, Calif. using a Rodel SPM 3100 polishing pad and Rodel NanoPure-8020 silica based slurry having a pH of 8–11 at a concentration net.

The first group of three wafers was planarized in accordance with the process illustrated in FIG. 2. The first of the three wafers was loaded into the CMP apparatus and processed for 60 seconds on a primary polish platen at an average optimized pressure of 3 pounds per square inch (psi), an orbit speed of 300 revolutions per minute (rpm), a carrier rotation speed of 16 rpm, and slurry flow rate of 200 milliliters per minute (ml/min) to achieve a substantially planar surface. The wafer was then transferred to a second polish platen to remove the majority of the residual slurry particle and surface damage remaining on the wafer surface from the first step. On the second polish platen the wafer was pressed against the polish pad with a pressure of 0.5 psi, orbit speed of 500 rpm, carrier rotation speed of 16 rpm and surfactant flow rate of 200 ml/min for 20 seconds. The wafer was then transferred to a PVA brush station where it was mechanically scrubbed and rinsed in a dilute ammonia hydroxide and de-ionized water solution at a brush pressure of 1.25 psi, an upper PVA brush rotational speed of 75 rpm and a lower brush rotational speed of 300 rpm. Finally, the wafer was removed to a non-contact spin rinse drier for final rinsing and drying for 15 seconds at 3500 rpm. The same process was repeated for the second and third wafers of the three wafer group.

The second group of three wafers was planarized in accordance with the process illustrated in FIG. 3. The first of the three wafers was loaded into the CMP apparatus and planarized in the same manner as the wafers of the first group. Instead of removing the wafer to a second polish platen, however, the wafer was maintained in contact with the primary polish platen. Following the initial planarization step the pressure on the wafer was reduced to 2 psi, the orbit speed remained at 300 rpm and the rotation speed was adjusted to 12 rpm. The delivery of slurry through the platen and polishing pad was terminated and was replaced by deionized water to rinse away the CMP slurry and CMP by products. After rinsing for 20 seconds, the flow of deionized water was terminated. The pressure and orbit speed remained the same as in the rinse step, the carrier speed was reduced to 9 rpm, and a cleaning solution at a temperature of 34° C. of 150 ml/min of de-ionized water, hydrogen peroxide, and ammonium hydroxide was introduced to cause chemical mechanical cleaning (CMC) of the wafer surface. The CMC was continued for 50 seconds. After the CMC, the wafer was transferred to a spin rinse dryer for a 25 second final rinse with de-ionized water and 15 second spin dry at 3500 rpm. The same process was repeated for the second and third wafers of the three wafer group.

After drying, all of the wafers from both groups were analyzed for light point defects (LPD), a measure of surface defects using laser scanning technology. LPDs having a size greater than 0.13 micrometers ($\mu$m) were measured using model SP1 laser scanning equipment available from KLA-Tencor using settings and techniques recommended by the manufacturer. LPDs were found to be reduced by as much as two orders of magnitude in using the CMP method in accordance with the invention in contrast to the conventional method.

The inventors have found that using chemical mechanical cleaning, in accordance with the invention, removes particles that cannot be dislodged by the conventional process. The combination of the mechanical aspects of the cleaning with the chemical aspects aids in dislodging contaminant particles and preventing them from redepositing on the wafer surface. After the conventional CMP process the surface of the wafer is hydrophobic. In contrast, following CMC in accordance with the invention, the surface of the wafer is hydrophilic. The use of the water-hydrogen peroxide-base cleaning solution following the rinse step oxidizes the surface of the silicon wafer making it hydrophilic. The oxidation of the surface is aided by the mechanical portion of the CMC because of the heat generated by frictional forces between the wafer surface and polishing pad as the two are in relative motion. The oxidized wafer surface has the same or similar zeta potential as does the silica particles in the slurry because they are both $SiO_2$. Because the zeta potentials are similar, an electrostatic repulsion between the silica and the oxidized surface prevents or reduces the affinity for re-adhesion of the particle to the surface once it is dislodged.

The inventors have discovered through additional experiments that preferred CMC conditions are as follows, although some of these conditions are dependent on the particular CMP apparatus employed. Pressure between the wafer and the polishing pad during the planarization step can be between about 0.5 pounds psi and 6 psi and most preferably about 3 psi. Pressure between the wafer and the polishing pad during the CMC step can be in the same range and most preferably is about 2 psi. Formulation of the $H_2O_2$:$NH_4OH$:$H_2O$ can be from about 3:1:1 to about 8:1:1 and most preferably is about 5:1:1. Temperature of the $H_2O_2$:$NH_4OH$:$H_2O$ can range from about 25° C. to about 45° C. and most preferably is about 34° C. In addition, other weak bases having a dissociation constant range $6.6\times10^{-7}$ to $1.3\times10^{-4}$ can be substituted for the ammonium hydroxide and other oxidants, such as ammonia persulfate, can be substituted for the hydrogen peroxide. The processing time for the CMC step can be from about 15 seconds to about 90 seconds and most preferably is about 50 seconds.

While at least one exemplary embodiment has been presented in the foregoing detailed description, it should be appreciated that a vast number of variations exist. It should also be appreciated that the exemplary embodiments are only examples, and are not intended to limit the scope, applicability, or configuration of the invention in any way. Rather, the foregoing detailed description will provide those skilled in the art with a convenient road map for implementing the exemplary embodiments. It should be understood that various changes can be made in the function and arrangement of elements without departing from the scope of the invention as set forth in the appended claims and the legal equivalents thereof.

What is claimed is:

1. A method for planarizing a surface of a semiconductor wafer comprising the steps of:

subjecting the semiconductor wafer having a surface to a chemical mechanical planarization process on a first chemical mechanical planarization platen such that the planarization process leaves the surface hydrophobic; and subjecting the semiconductor wafer to a cleaning process on the same first chemical mechanical planarization platen such that the cleaning process leaves the surface hydrophilic.

2. The method of claim 1 wherein the step of subjecting the semiconductor wafer having a surface to a chemical mechanical planarization process comprises the step of pressing the surface of the semiconductor wafer against a polishing pad attached to the first chemical mechanical planarization platen in the presence of a slurry.

3. The method of claim 2 wherein the step of pressing the surface of the semiconductor wafer against a polishing pad in the presence of a slurry comprises pressing the surface of the semiconductor wafer against the polishing pad at a first pressure in the presence of a slurry selected to leave the surface hydrophobic.

4. A method for planarizing a surface of a semiconductor wafer comprising the steps of:

subjecting the semiconductor wafer having a surface to a chemical mechanical planarization process on a chemical mechanical planarization platen such that the planarization process leaves the surface hydrophobic;

subjecting the semiconductor wafer to a cleaning process on the chemical mechanical planarization platen such that the cleaning process leaves the surface hydrophilic; and rinsing the semiconductor wafer in a fluid comprising water after the step of subjecting the semiconductor wafer having a surface to a chemical mechanical planarization process and before the step of subjecting the semiconductor wafer to a cleaning process.

5. A method for planarizing a surface of a semiconductor wafer comprising the steps of:

subjecting the semiconductor wafer having a surface to a chemical mechanical planarization process on a chemical mechanical planarization platen such that the planarization process leaves the surface hydrophobic; and subjecting the semiconductor wafer to a cleaning process on the chemical mechanical planarization platen in the presence of a fluid comprising an oxidant such that the cleaning process leaves the surface hydrophilic.

6. The method of claim 5 wherein the step of pressing the surface of the semiconductor wafer against the platen at a second pressure comprises pressing the surface of the semiconductor wafer against the polishing pad attached to the platen at a second pressure in the presence of a fluid comprising hydrogen peroxide and a base.

7. The method of claim 6 further comprising the steps of:

placing the surface of the semiconductor wafer in motion relative to the platen at a first relative motion speed during the step of subjecting the semiconductor wafer having a surface to a chemical mechanical planarization process; and placing the surface of the semiconductor wafer in motion relative to the platen at a second relative motion speed during the step of subjecting the semiconductor wafer to a cleaning process.

8. The process of claim 7 wherein the second relative motion speed is different than the first relative motion speed.

9. The method of claim 8 further comprising the step of rinsing the semiconductor wafer in a fluid comprising water after the step of subjecting the semiconductor wafer having a surface to a chemical mechanical planarization process and before the step of subjecting the semiconductor wafer to a cleaning process.

10. The process of claim 9 further comprising the step of drying the surface of the semiconductor wafer following the step of subjecting the semiconductor wafer to a cleaning process.

11. A process for planarizing a surface of a semiconductor wafer comprising the sequential steps of:

pressing the surface of the semiconductor wafer against a first polishing pad on a first platen in the presence of a polishing slurry to planarize the surface and to make the surface hydrophobic;

pressing the surface of the semiconductor wafer against the same first polishing pad on the same first platen in the presence of a rinsing fluid; and pressing the surface of the semiconductor wafer against the same first polishing pad on the same first platen in the presence of a cleaning liquid selected to render the surface hydrophilic.

12. The method of claim 11 further comprising the step of:

causing relative motion between the surface of the semiconductor wafer and the first polishing pad; and controlling the speed of relative motion to a first speed in the presence of a polishing slurry, a second speed in the presence of a rinsing fluid and a third speed in the presence of cleaning liquid.

13. A process for planarizing a surface of a semiconductor wafer comprising the sequential steps of:

pressing the surface of the semiconductor wafer against a polishing pad on a platen in the presence of a polishing slurry to planarize the surface and to make the surface hydrophobic;

pressing the surface of the semiconductor wafer against the polishing pad on the platen in the presence of a rinsing fluid comprising water; and pressing the surface of the semiconductor wafer against the polishing pad on the platen in the presence of a cleaning liquid selected to render the surface hydrophilic.

14. A process for planarizing a surface of a semiconductor wafer comprising the sequential steps of:

pressing the surface of the semiconductor wafer against a polishing pad on a platen in the presence of a polishing slurry to planarize the surface and to make the surface hydrophobic;

pressing the surface of the semiconductor wafer against the polishing pad on the platen in the presence of a rinsing fluid; and pressing the surface of the semiconductor wafer against the polishing pad on the platen in the presence of a cleaning fluid comprising an oxidant and a base selected to render the surface hydrophilic.

15. A process for planarizing a surface of a semiconductor wafer comprising the sequential steps of:

pressing the surface of the semiconductor wafer against a polishing pad on a platen in the presence of a polishing slurry to planarize the surface and to make the surface hydrophobic;

pressing the surface of the semiconductor wafer against the polishing pad on the platen in the presence of a rinsing fluid; and pressing the surface of the semiconductor wafer against the polishing pad on the platen in the presence of a cleaning fluid comprising hydrogen peroxide and ammonium hydroxide selected to render the surface hydrophilic.

16. A method for polishing a surface of a work piece comprising the steps of:

loading the work piece into a work piece carrier;

positioning the work piece and the work piece carrier over a polishing pad;

initiating relative motion between the work piece and the work piece carrier and the polishing pad;

pressing a surface of the work piece against the polishing pad at a first pressure in the presence of a polishing compound; and subsequently pressing the surface of the work piece against the polishing pad at a second pressure in the presence of a cleaning fluid comprising an oxidant and a base.

17. The method of claim 16 wherein the step of pressing comprises pressing a surface of the work piece against the polishing pad in the presence of a polishing slurry that leave the surface hydrophobic.

18. The method of claim 17 wherein the step of subsequently pressing comprises the step of subsequently pressing the surface of the work piece against the polishing pad in the presence of a solution that leaves the surface hydrophilic.

19. The method of claim 18 further comprising the step of pressing a surface of the work piece against the polishing pad at a third pressure in the presence of a rinsing fluid following the step of pressing a surface of the work piece against the polishing pad at a first pressure in the presence of a polishing compound.

* * * * *